US008976001B2

(12) United States Patent
Chen et al.

(10) Patent No.: US 8,976,001 B2
(45) Date of Patent: Mar. 10, 2015

(54) PROTECTIVE DEVICE

(75) Inventors: Kuo-Shu Chen, Hsin-Chu (TW); Chung-Hsiung Wang, Hsin-Chu (TW)

(73) Assignee: Cyntec Co., Ltd., Hsin-Chu (TW)

( * ) Notice: Subject to any disclaimer, the term of this patent is extended or adjusted under 35 U.S.C. 154(b) by 676 days.

(21) Appl. No.: 13/291,884

(22) Filed: Nov. 8, 2011

(65) Prior Publication Data

US 2012/0112871 A1 May 10, 2012

(30) Foreign Application Priority Data

Nov. 8, 2010 (TW) ..... 99221646 U

(51) Int. Cl.

| | |
|---|---|
| ***H01H 85/44*** | (2006.01) |
| ***H01H 85/044*** | (2006.01) |
| ***H01H 85/055*** | (2006.01) |
| ***H01H 85/046*** | (2006.01) |
| *H01H 85/041* | (2006.01) |
| *H01H 85/02* | (2006.01) |

(Continued)

(52) U.S. Cl.

CPC ..... *H01H 85/044* (2013.01); *H01H 85/055* (2013.01); *H01H 85/0411* (2013.01); *H01H 85/046* (2013.01); *H01H 85/0241* (2013.01); *H01H 85/463* (2013.01); *H01H 69/02* (2013.01); *H01H 69/022* (2013.01)

USPC ..... 337/297; 337/153; 337/182; 337/183; 337/416; 337/295; 337/160

(58) Field of Classification Search

CPC . H01H 85/046; H01H 85/0411; H01H 85/10; H01H 85/0241; H01H 85/048; H01H 85/463; H01H 85/11; H01H 85/055; H01H 85/36; H01H 69/022; H01H 69/02; H01H 2085/466

USPC ..... 337/297, 153, 182, 183, 416, 295, 160

See application file for complete search history.

(56) References Cited

U.S. PATENT DOCUMENTS 4,749,980 A * 6/1988 Morrill et al. ..... 337/232
5,001,451 A * 3/1991 Morrill et al. ..... 337/247

(Continued)

FOREIGN PATENT DOCUMENTS

CN 1748279 A 3/2006
JP 11185580 A 7/1999

(Continued)

OTHER PUBLICATIONS

Siewert et al. "Properties of Lead-Free Solders" Feb. 11, 2002 (see attached).*

*Primary Examiner* — Anatoly Vortman
(74) *Attorney, Agent, or Firm* — Chun-Ming Shih; HDLS IPR Services

(57) ABSTRACT

A protective device includes a substrate, two first electrodes, a low-melting point metal layer and an assisting layer. The first electrodes are respectively arranged at two opposite sides of the substrate. The low melting point metal layer is arranged over the two first electrodes. The assisting layer is formed on the low melting point metal layer. The liquidus temperature of the assisting layer is below the liquidus temperature of the low melting point metal layer, and the liquidus temperature of the assisting layer is not below a predetermined temperature which is below the maximum working temperature of reflow soldering process by 25 degrees.

18 Claims, 5 Drawing Sheets

(51) Int. Cl.

| | |
|---|---|
| *H01H 85/46* | (2006.01) |
| *H01H 69/02* | (2006.01) |

(56) References Cited

U.S. PATENT DOCUMENTS

| | | | | |
|---|---|---|---|---|
| 5,027,101 | A * | 6/1991 | Morrill, Jr. | 337/297 |
| 5,032,817 | A * | 7/1991 | Morrill et al. | 337/247 |
| 5,097,245 | A * | 3/1992 | Morrill, Jr. | 337/247 |
| 5,122,774 | A * | 6/1992 | Morrill et al. | 337/246 |
| 5,155,462 | A * | 10/1992 | Morrill, Jr. | 337/3 |
| 5,712,610 | A * | 1/1998 | Takeichi et al. | 337/290 |
| 5,939,969 | A * | 8/1999 | Doerrwaechter et al. | 337/297 |
| 6,269,745 | B1 * | 8/2001 | Cieplik et al. | 102/202.5 |
| 6,344,633 | B1 * | 2/2002 | Furuuchi | 219/517 |
| 6,373,371 | B1 * | 4/2002 | Doerrwaechter et al. | 337/297 |
| 6,452,475 | B1 * | 9/2002 | Kawazu et al. | 337/290 |
| 7,286,037 | B2 * | 10/2007 | Furuuchi | 337/290 |
| 8,289,123 | B2 * | 10/2012 | Whitney et al. | 337/295 |
| 2001/0044168 | A1 * | 11/2001 | Furuuchi et al. | 438/107 |
| 2002/0014945 | A1 * | 2/2002 | Furuuchi et al. | 337/158 |
| 2005/0140491 | A1 * | 6/2005 | Uehara et al. | 337/401 |
| 2005/0141164 | A1 * | 6/2005 | Bender et al. | 361/104 |
| 2005/0264394 | A1 * | 12/2005 | Furuuchi | 337/182 |
| 2006/0028314 | A1 * | 2/2006 | Furuuchi | 337/4 |
| 2006/0125594 | A1 * | 6/2006 | Furuuchi | 337/4 |
| 2006/0170528 | A1 * | 8/2006 | Fukushige et al. | 337/297 |
| 2009/0016953 | A1 * | 1/2009 | Weil et al. | 423/593.1 |
| 2009/0102595 | A1 * | 4/2009 | Pachla et al. | 337/297 |
| 2010/0245022 | A1 * | 9/2010 | Galla et al. | 337/159 |
| 2010/0245027 | A1 * | 9/2010 | Matthiesen et al. | 337/297 |
| 2012/0194317 | A1 * | 8/2012 | Vranicar et al. | 337/401 |
| 2013/0099890 | A1 * | 4/2013 | Yoneda | 337/416 |
| 2013/0200984 | A1 * | 8/2013 | Matthiesen et al. | 337/186 |

FOREIGN PATENT DOCUMENTS

| | | | |
|---|---|---|---|
| TW | 200926239 | A | 6/2009 |
| TW | 201030791 | A | 8/2010 |
| WO | 2010084817 | A1 | 7/2010 |
| WO | 2010084819 | A1 | 7/2010 |

* cited by examiner

PROTECTIVE DEVICE

BACKGROUND OF THE INVENTION

1. Field of the Invention

The present invention relates to an electronic device, in particularly to a protective device capable of protecting electronic apparatus having it from damage by excessive current or excessive voltage.

2. Description of Related Art

In order to protect battery and battery charger from damage caused by excessive current or excessive voltage while charging is performed, a protective device is often put into the battery charger. Thus, when the excessive current or voltage is applied on the battery charger, the protective device can interrupt the circuit therein immediately and protect the battery and the electronic components in the battery charger.

FIG. 1 is a circuit diagram of a battery charger. There is a protective device 11 in the excessive current/voltage protective circuit 10 of the battery charger. The protective device 11 has two current fuses 111 and 112 arranged between the node A and node B. The current fuses 111 and 112 are made of low melting point metal and can be broken by excessive charging current passing therethrough. Consequently, the circuit between the node A and node B are interrupted and the battery 12 and the electronic elements in the battery charger can be protected.

Besides, the excessive current/voltage protective circuit 10 has an integrated circuit 13 for detecting excessive voltage. Once an excessive voltage is detected, the integrated circuit 13 will conduct a MOSFET 14 and the electrical current thus can be allowed to pass through path C. Then the heating member 113 of the protective device 11 generates heat for melting the current fuses 111 and 112 and a breakage is formed for protecting the battery 12 and the battery charger.

More specifically, as FIG. 2 shows, the protective device 20 has a substrate 21, two first electrodes 22 respectively formed at two opposite sides of the substrate 21, and a low melting point metal layer 23 electrically connected across the two first electrodes 22. A current path is formed from one of the first electrodes 22 to the low melting point metal layer 23 and then to the other one of the first electrodes 22. So once excessive current enters either of the first electrodes 22, the low melting point metal layer 23 will melt to break and form a breakage between the two first electrodes 22.

As shown in FIG. 2 and FIG. 3, the protective device 20 has two second electrodes 24 formed at another two opposite sides of the substrate 21. The two second electrodes 24 each have an extending portion 241 extending under the low melting point metal layer 23. A heating member 25 is formed between the two extending portions 241. An insulating layer 27 is provided for covering the heating member 25 and the second electrodes 24. Another current path is formed from one of the second electrodes 24 to the heating member 25 and then to the other one of the second electrodes 24. Once current with excessive voltage enters either of the second electrodes 24 of this current path, the heating member 25 will generate heat for melting and breaking the low melting point metal 23 and form a breakage. In addition, the second electrode 24 at the right side of FIG. 3 has a third electrode 242 and electrically extending to the low melting point metal layer 23.

In order to rapidly break up the low melting point metal layer 23, an appropriate amount of flux 26 is applied on the low melting point metal layer 23 for preventing oxidation occurred on the surface of the low melting point metal layer 23. Besides, the flux 26 can remove the oxide layer formed on the low melting point metal layer 23 and help to increase the breaking thereof. The main composition of the flux 26 is rosin, which has a liquidus temperature as low as between 50 to 80 degrees Celsius. When the protective device 20 is being connected to a circuit board in a reflow soldering process, the high temperature over 200 degrees Celsius therein will immediately evaporate the flux or drive it to move away. Without the flux, the low melting point metal layer 23 will not easily be melted to break when an excessive current or voltage is applied on the protective device 20, and the protective device 20 will fail to give any protection to the battery charger or the battery.

SUMMARY OF THE INVENTION

The objective of the present invention is to provide a protective device for solving the above problem of the flux evaporating or moving away in the reflow soldering process. The protective device is capable of protecting the battery and the battery charger when excessive current or voltage is applied thereon.

For achieving the above objective, the protective device of the present invention includes a substrate, two first electrodes, a low-melting point metal layer and an assisting layer. The two first electrodes are respectively arranged at two opposite sides of the substrate. The low-melting point metal layer is arranged over the two first electrodes. The assisting layer is formed on the low-melting point metal layer. The liquidus temperature of the assisting layer is below the liquidus temperature of the low-melting point metal layer, and the liquidus temperature of the assisting layer is not below a predetermined temperature which is below the maximum working temperature of reflow soldering process by 25 degrees.

In another aspect, the present invention also provides a protective device, which includes a substrate, a low-melting point metal layer, an assisting layer, a bridging structure and a heating member. The low-melting point metal layer is arranged over the substrate. The assisting layer is formed on the low-melting point metal layer. The bridging structure crosses the low melting point metal layer. The heating member is arranged on the substrate. The liquidus temperature of the assisting layer is below the liquidus temperature of the low-melting point metal layer, and the liquidus temperature of the assisting layer is not below a predetermined temperature, the predetermined temperature is below the maximum working temperature of reflow soldering process by 25 degrees.

DETAILED DESCRIPTION OF THE INVENTION

A detailed description of the present invention will be made with reference to the accompanying drawings.

Figure 1:
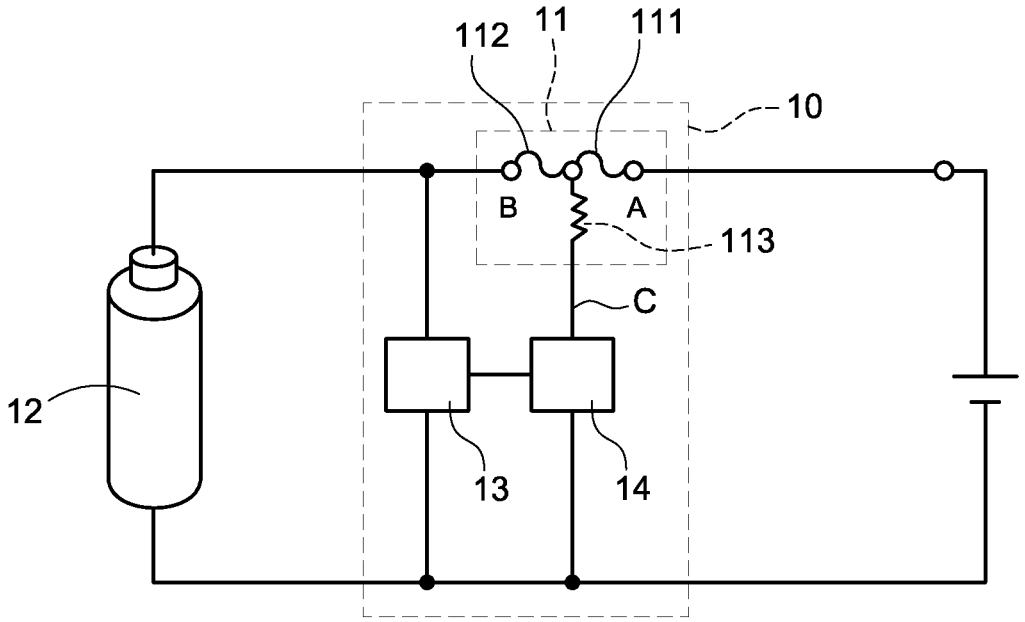
FIG.1 (Prior Art)
FIG. 1 is a circuit diagram of a conventional battery charger.
Figure 2:
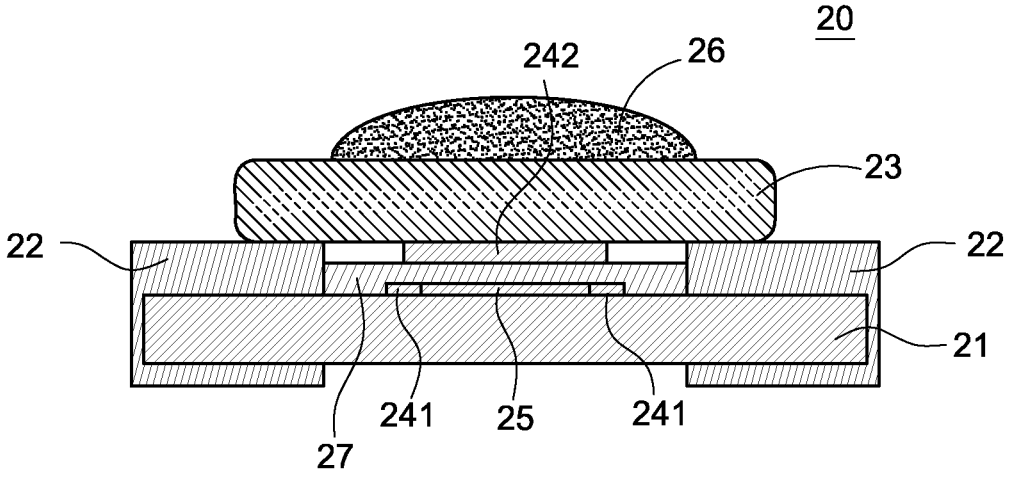
FIG.2 (Prior Art)
FIG. 2 is a cross sectional view of a conventional protective device.
Figure 3:
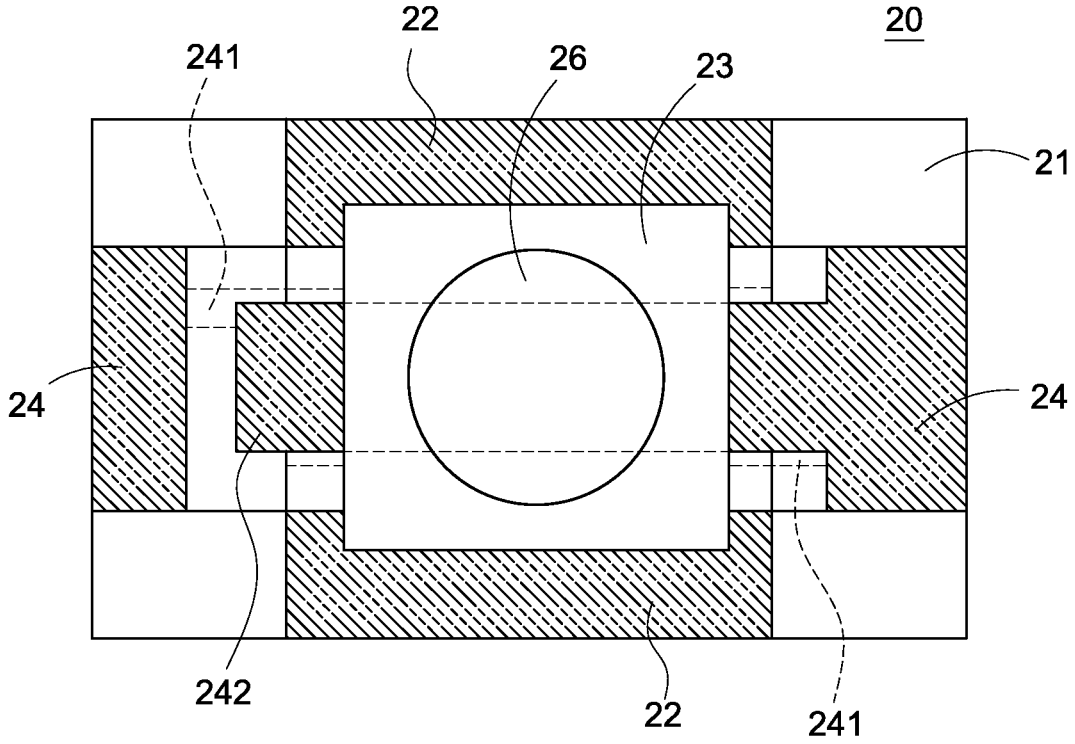
FIG.3 (Prior Art)
FIG. 3 is a top view of a conventional protective device.
Figure 4:
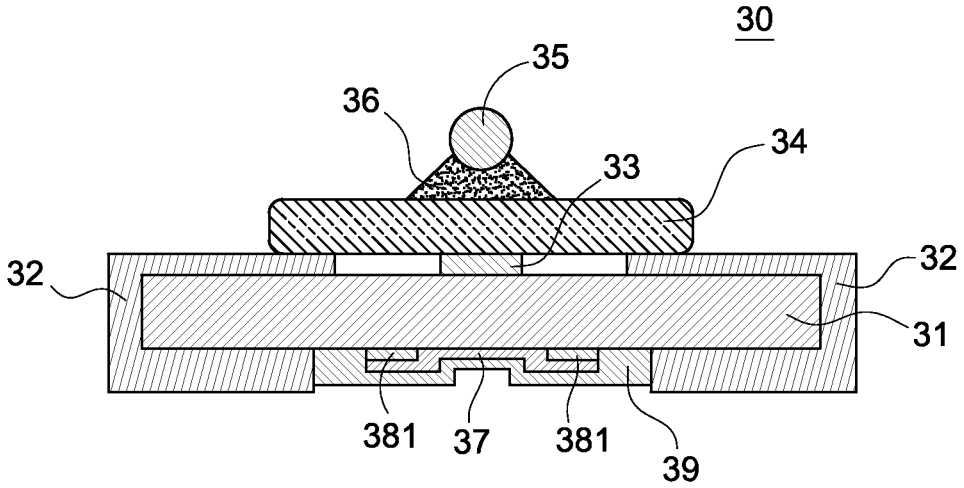
FIG. 4 is a cross sectional view of a protective device according to the first embodiment of the present invention.

FIG. 4 is a cross sectional view showing a protective device according to the first embodiment of the present invention. In this embodiment, the protective device 30 is a surface mount type electronic device, which can be mounted to a circuit board by a reflow soldering process. The protective device 30 includes a substrate 31 made of insulating material and having a shape of rectangular plate. Specifically, the materials for the substrate can be inorganic material including ceramic like aluminum oxide, zirconium dioxide, silicon nitride, aluminum nitride and boron nitride, or can be plastic, glass or epoxy. In practical use, the inorganic material is preferred.

Above the substrate 31, the protective device 30 includes two first electrodes 32 respectively arranged at two opposite sides of the substrate 31, a third electrode 33 extending between the two first electrodes 32 and a low melting point metal layer 34 arranged over the first electrodes 32 and the third electrode 33. The low melting point metal layer 34 is soldered onto the first electrodes 32 and the third electrode 33 with a solder material and thus forms an electrical connection with the first electrodes 32 and the third electrode 33. The materials for the low melting point metal layer 34 include tin-lead alloy, tin-silver-lead alloy, tin-indium-bismuth-lead alloy, tin-antimony alloy, tin-silver-copper alloy.

Figure 5:
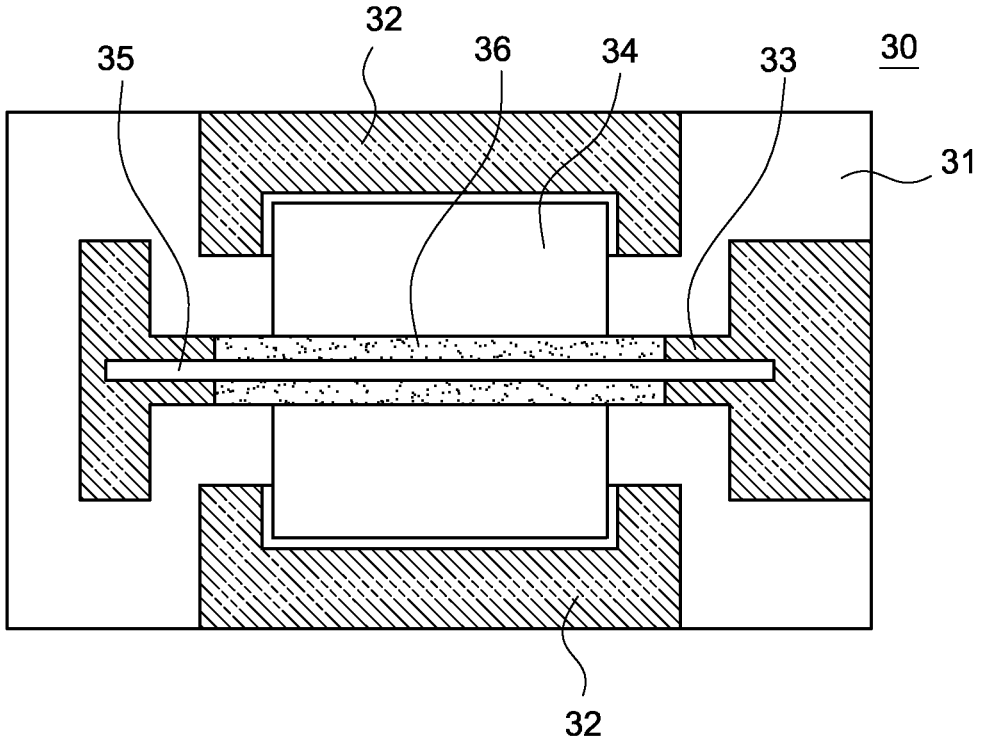
FIG. 5 is a top view of the protective device according to the first embodiment of the present invention.
Figure 6:
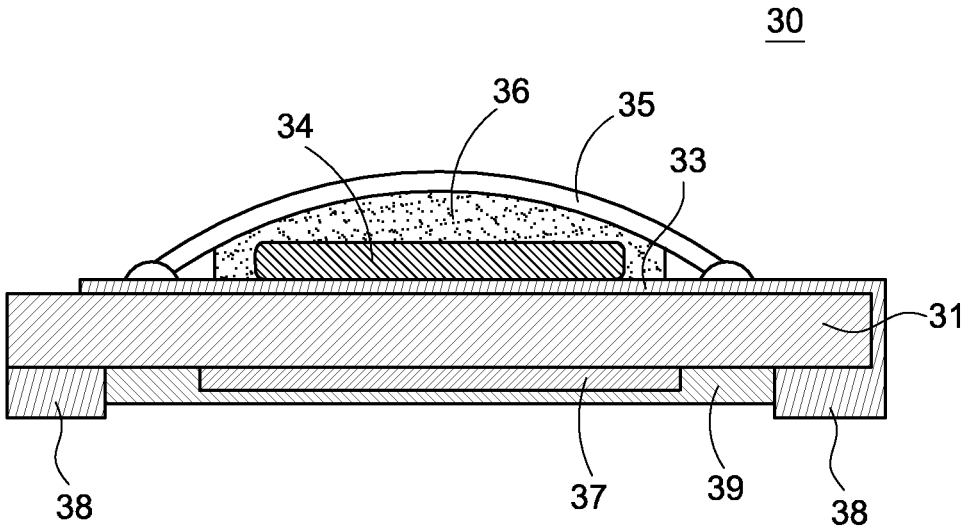
FIG. 6 is another cross sectional view of the protective device according to the first embodiment of the present invention.

FIG. 5 is an upper view of the protective device 30. The third electrode 33 laterally extends along the substrate 31 and is substantially of dumbbell shape. The low melting point metal layer 34 covers the middle portion of the third electrode 33 and the two opposite ends of the third electrode 33 are exposed. As FIG. 5 and FIG. 6 show, the protective device 30 further includes a bridging structure 35 located over the low melting point metal layer 34. The bridging structure 35 is connected to the two ends of the third electrode 33, and crosses o-ver the low melting point metal layer 34. The materials for the bridging structure 35 can be gold, silver, nickel, tin, silver-copper alloy, nickel-copper alloy, tin-nickel-copper alloy, tin-nickel alloy. The connection between the bridging structure 35 and the two exposed ends of the third electrode 33 can be made by soldering, arc welding, ultrasonic welding, laser welding, and thermal pressure welding.

In addition, the protective device 30 further includes an assisting layer 36 located between the bridging structure 35 and the low melting point metal layer 34. Preferably, the assisting layer 36 in its molten phase has good wettability with respect to the bridging structure 35 and is miscible with the low melting point metal layer 34. So the assisting layer 36 can help the molten low melting point metal layer 34 remain between the bridging structure 35 and the third electrode 33, and help the low melting point metal layer 34 melted to break. In manufacturing, the assisting layer 36 is formed by first dispensing liquid material between the bridging structure 35 and the low melting point metal layer 34 and then solidifying the liquid material. Because of having good flowability in its molten phase, the assisting layer 36 is formed through capillary action into a fan shape between the bridging structure 35 and the low melting point metal layer 34.

When the protective device 30 is practically mounted to a circuit board through reflow soldering process, the assisting layer 36 will remain between the bridging structure 35 and the low melting point metal layer 34 and will not be evaporated or driven to move like conventional flux. Therefore, when an excessive voltage or current is applied, the assisting layer 36 can help the low melting point metal layer 34 precisely and stably melted to break.

Besides, it should be noticed that the liquidus temperature of the assisting layer 36 is below the liquidus temperature of the low-melting point metal layer 34. However, if the assisting layer 36 has too low a liquidus temperature, the assisting layer 36 will be easily miscible with the low melting point metal layer 34 through reflow soldering process, and thus changes the value of both the liquidus temperature and resistance of the low melting point metal layer 34. Consequently, it causes the melting stability of the protective device to become worse. Therefore, the liquidus temperature of the assisting layer 36 is needed to be set within a specifically preferable range. Thus, the liquidus temperature of the assisting layer 36 should be not below a predetermined temperature. The predetermined temperature is below the maximum working temperature of reflow soldering process by 25 degrees Celsius. Preferably, the liquidus temperature of the assisting layer 36 is not below the maximum working temperature of reflow soldering process. The composition of the assisting layer 36 is determined according to the composition of the low melting point metal layer 34. In this embodiment, since the composition of the low melting point metal layer 34 includes tin, the composition of the assisting layer 36 can accordingly include tin for obtaining better miscibility with the low melting point metal layer 34 and helping the low melting point metal layer 34 melted. For illustration, the assisting layer 36 can be tin-silver alloy, tin-lead alloy, tin-silver-copper alloy, tin-antimony alloy or tin-lead-antimony alloy. It should be mentioned that the better miscibility may be obtained by other ways without having similar compositions as above described.

Figure 7:
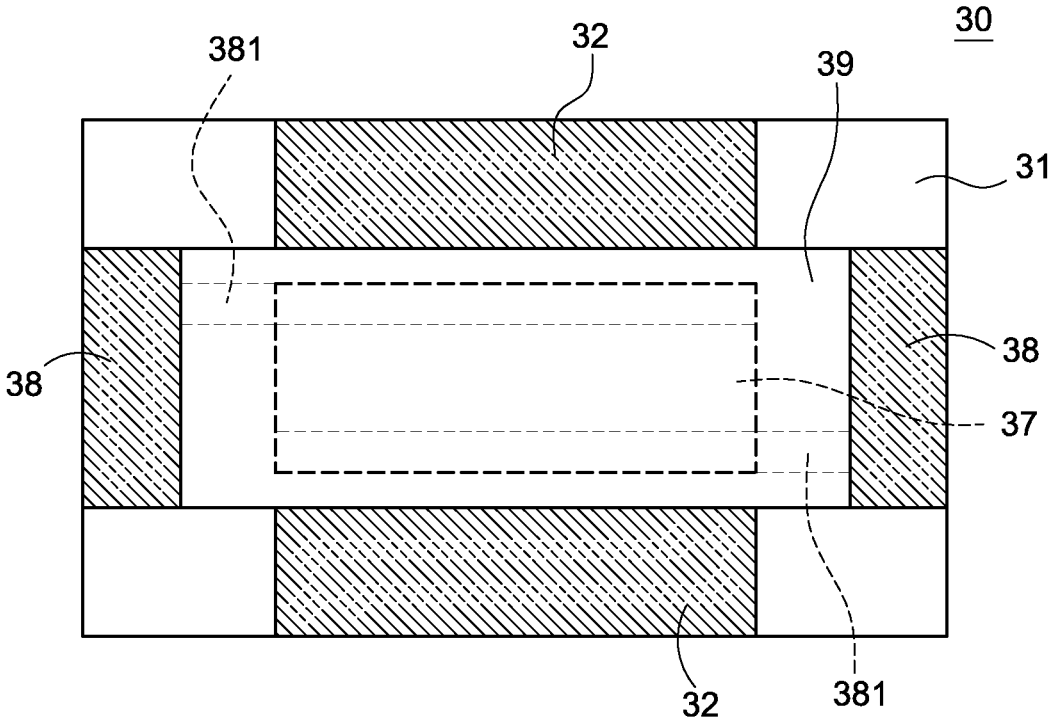
FIG. 7 is a bottom view of the protective device according to the first embodiment of the present invention.

As FIG. 4 and FIG. 7 show, the protective device 30 includes a heating member 37 located at the lower surface of the substrate 31, and two second electrodes 38 respectively arranged at another two opposite sides of the substrate 31. The two second electrodes 38 each have an extending portion 381 extending along the lower surface of the substrate 31 and electrically connected with the heating member 37. One of the second electrodes 38 is electrically connected with the third electrode 33. Besides, the protective device 30 further includes an insulating layer 39 covering the heating member 37 and the extending portions 381.

Figure 8:
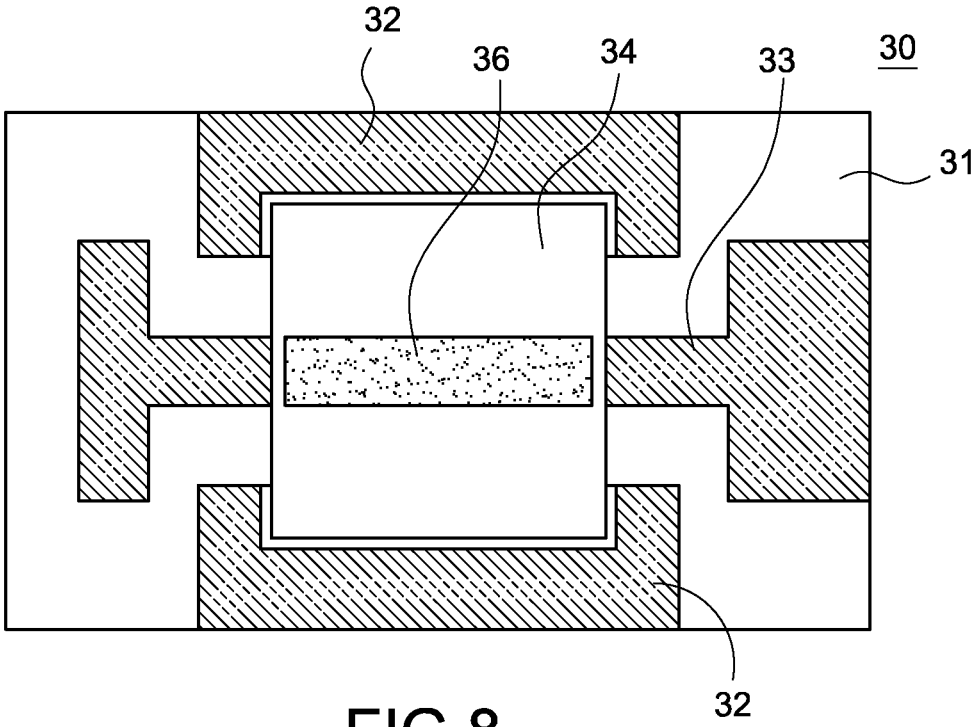
FIG. 8 is a top view of the protective device according to another example of the first embodiment of the present invention.
Figure 9:
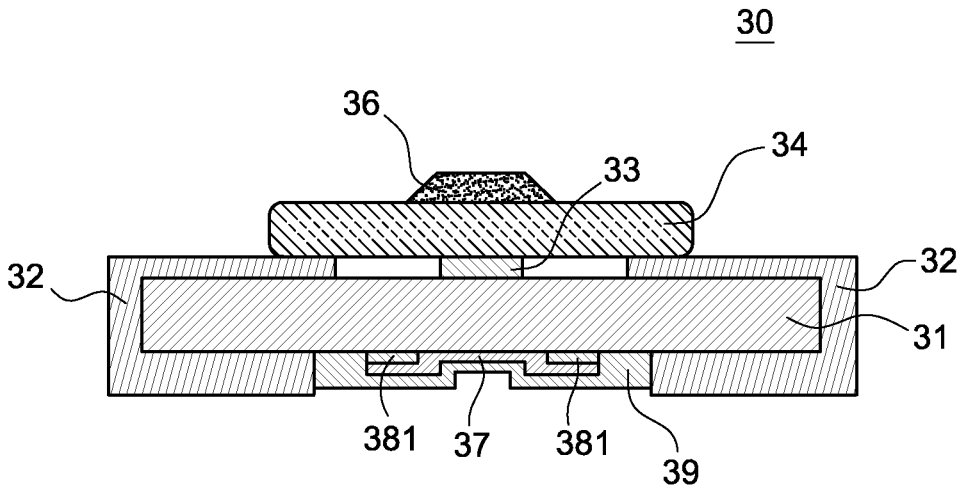
FIG. 9 is a cross sectional view of the protective device according to another example of the first embodiment of the present invention.

In the above mentioned first embodiment, the bridging structure 35 is provided so as to fix the assisting layer 36 between the bridging structure 35 and the low melting point metal layer 34. In another embodiment, as FIG. 8 and FIG. 9 show, the assisting layer 36 can be directly applied on the low melting point metal layer 34 without forming the bridging structure 35 in advance. Since the composition of the assisting layer 36 is determined according to the composition of the low melting point metal layer 34, which implies that both of them have similar composition. With the similar composition, the assisting layer 36 can be effectively fixed onto the low melting point metal layer 34 and will not be evaporated or driven to move like conventional flux. When an excessive voltage or current is applied, the assisting layer 36 can help the low melting point metal layer 34 precisely and stably melted to break.

Besides, the assisting layer 36 can help additionally added flux fixing on the low melting point metal layer 34. The assisting layer 36 only should be put above the third electrode 33 but needs not to cover the entire low melting point metal layer 34. The material for the assisting layer 36 can include tin, silver, copper or alloy thereof. Conventional soldering tin paste with or without flux can also be adopted as the assisting layer 36.

Figure 10:
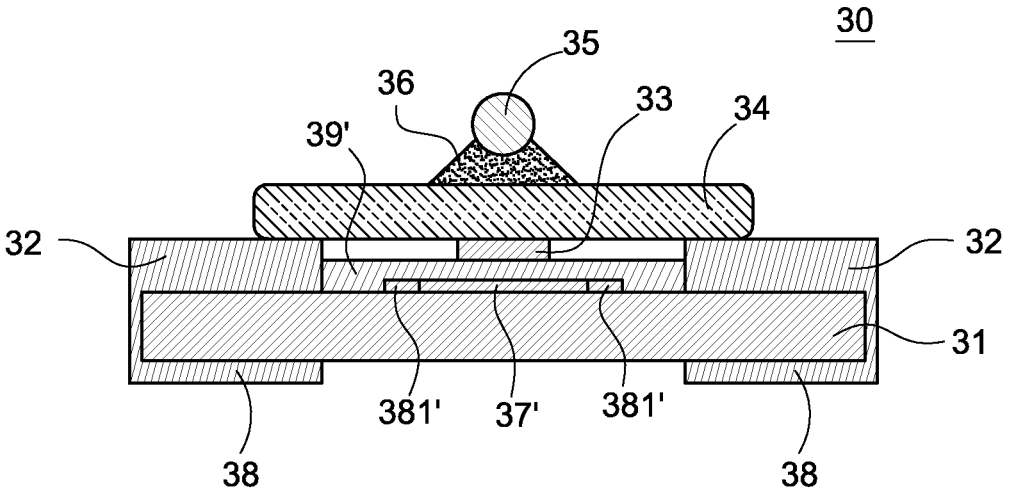
FIG. 10 is a cross sectional view of the protective device according to the second embodiment of the present invention.

FIG. 10 shows a protective device 30 according to the second embodiment of the present invention. The difference with respect to the first embodiment is that in present embodiment, the heating member 37', the extending portion 381' of the second electrode 38, and the insulating layer 39' are arranged on the upper surface of the substrate 31 and under the third electrode 33. More specifically, the heating member 37' is located between the upper surface of the substrate 31 and the third electrode 33. The insulating layer 39' is located between the heating member 37' and the third electrode 33. The extending portions 381' extend along the upper surface of the substrate 31 and electrically connect with the heating member 37'.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A protective device, comprising:

a substrate having a top surface and a bottom surface opposite to the top surface;

two first electrodes respectively arranged at two opposite sides of the substrate;

a low-melting point metal layer arranged over the two first electrodes and having a first surface facing the top surface of the substrate and a second surface opposite to the first surface;

an assisting layer formed on the second surface of the low-melting point metal layer, and a bridging structure directly contacting with the assisting layer on the second surface of the low-melting point metal layer, wherein a first liquidus temperature of the assisting layer is below a second liquidus temperature of the low-melting point metal layer, and the first liquidus temperature of the assisting layer is not below a predetermined temperature, the predetermined temperature is below a maximum temperature of reflow soldering process by 25 degrees Celsius.

2. The protective device as claim 1, wherein the first liquidus temperature of the assisting layer is not below the maximum temperature of reflow soldering process.

3. The protective device as claim 1, wherein the assisting layer comprises tin.

4. The protective device as claim 1, further comprising a third electrode directly disposed on the top surface of the substrate and between the two first electrodes, and sandwiched between the low melting point metal layer and the substrate.

5. The protective device as claim 4, wherein the bridging structure is atop the third electrode.

6. The protective device as claim 5, wherein the assisting layer is formed by applying a liquid material between the bridging structure and the low melting point metal layer and solidifying the liquid material.

7. The protective device as claim 1, further comprising a heating member disposed on the bottom surface of the substrate and two second electrodes respectively arranged at another two opposite sides of the substrate, wherein the two second electrodes are electrically connected to the heating member.

8. The protective device as claim 4, wherein one of the second electrodes is electrically connected to the third electrode.

9. The protective device as claim 1, wherein the substrate is made of an inorganic material.

10. The protective device as claim 1, wherein the assisting layer is made of material comprising tin, silver, copper or an alloy thereof.

11. A protective device, comprising:

a substrate having a top surface and a bottom surface opposite to the top surface;

a low-melting point metal layer arranged over the substrate and having a first surface facing the top surface of the substrate and a second surface opposite to the first surface;

an assisting layer formed on the second surface of the low-melting point metal layer;

a bridging structure crossing the low melting point metal layer and directly contacting with the assisting layer on the second surface of the low-melting point metal layer; and a heating member disposed on the top surface of the substrate, wherein a first liquidus temperature of the assisting layer is below a second liquidus temperature of the low-melting point metal layer, and the first liquidus temperature of the assisting layer is not below a predetermined temperature, the predetermined temperature is below a maximum temperature of reflow soldering process by 25 degrees Celsius.

12. The protective device as claim 11, wherein the first liquidus temperature of the assisting layer is not below the maximum temperature of reflow soldering process.

13. The protective device as claim 11, wherein the assisting layer comprises tin.

14. The protective device as claim 11, further comprising two first electrodes respectively arranged at two opposite sides of the substrate and electrically connected to the low-melting point metal layer, and a third electrode disposed between the two first electrodes and sandwiched between the low melting point metal layer and the substrate.

15. The protective device as claim 14, wherein the bridging structure is connected to the third electrode.

16. The protective device as claim 14, further comprising two second electrodes respectively arranged at another two opposite sides of the substrate, wherein the two second electrodes are electrically connected to the heating member and one of the second electrodes is electrically connected to the third electrode.

17. The protective device as claim 16, further comprising an insulating layer located between the heating member and the third electrode, and the two second electrodes respectively arranged at another two opposite sides of the substrate, wherein the two second electrodes are electrically connected to the heating member and one of the second electrodes is electrically connected to the third electrode.

18. The protective device as claim 11, wherein the assisting layer is made of material comprising tin, silver, copper or an alloy thereof.

* * * * *